US006959927B1

(12) United States Patent
Jacobs et al.

(10) Patent No.: US 6,959,927 B1
(45) Date of Patent: Nov. 1, 2005

(54) MULTIPLE DEALERS BLACKJACK

(76) Inventors: Thomas W. Jacobs, 3308 Calle de Corrida, Las Vegas, NV (US) 89102; Kenneth M. Jacobs, 1685 E. Jamison Ave., Littleton, CO (US) 80122

( * ) Notice: Subject to any disclaimer, the term of this patent is extended or adjusted under 35 U.S.C. 154(b) by 0 days.

(21) Appl. No.: 10/032,676

(22) Filed: Oct. 19, 2001

(51) Int. Cl.[7] ..... A63F 1/00
(52) U.S. Cl. ..... 273/292; 463/12
(58) Field of Search ..... 273/292, 138.1, 273/139; 463/12, 13, 16–20

(56) References Cited

U.S. PATENT DOCUMENTS 3,796,433 A 3/1974 Fraley et al.
5,257,789 A 11/1993 LeVasseur
5,322,295 A 6/1994 Cabot et al.
5,377,993 A * 1/1995 Josephs ..... 463/12
5,413,353 A 5/1995 Demarest et al.
5,531,440 A 7/1996 Dabrowski et al.
5,549,300 A * 8/1996 Sardarian ..... 273/292
5,732,949 A * 3/1998 Josephs ..... 273/292
5,762,552 A * 6/1998 Vuong et al. ..... 463/25
5,785,606 A 7/1998 Marquez
5,816,575 A * 10/1998 Keller ..... 273/292
5,839,731 A 11/1998 Feola
5,954,335 A 9/1999 Moody
5,979,897 A 11/1999 Grossman
6,129,357 A 10/2000 Wichinsky
6,132,311 A * 10/2000 Williams ..... 463/13
6,146,271 A 11/2000 Kadlic
6,176,781 B1 1/2001 Walker et al.
6,270,405 B1 * 8/2001 Ferguson ..... 463/13
6,322,075 B1 * 11/2001 DeFranco ..... 273/274
6,406,023 B1 * 6/2002 Rowe ..... 273/292

* cited by examiner

*Primary Examiner*—Jessica Harrison
*Assistant Examiner*—Alex F. R. P. Rada, II
(74) *Attorney, Agent, or Firm*—Ramon L. Pizarro; Edwin H. Crabtree

(57) ABSTRACT

A gaming system and method based on a Blackjack card game using a dealer hold criteria and allowing a single player at a location to play blackjack against a plurality of dealers from a casino. The system and method allows the player to select the number of dealer hand positions, a player hand position, wager placement positions corresponding with each dealer hand position. The system compares, based on the rules of Blackjack, the player hold hand to each dealer hold hand to determine if the player hold hand wins over any of the dealer hold hands. The single player is then credited for each dealer hold hand that is beat by the player hold hand and the casino is credited for each dealer hold hand that is not beat by a player hold hand, so that the single player carries out multiple games of blackjack based on the player hold hand.

16 Claims, 3 Drawing Sheets

MULTIPLE DEALERS BLACKJACK

BACKGROUND OF THE INVENTION (a) Field of the Invention

This invention generally relates to a gaming system and method that allows a single player to play a wagering game of blackjack against multiple dealers. A system and method for playing multiple hands by a player against multiple dealers is also described.

(b) Discussion of Known Art

The gaming industry can be fairly categorized as providing entertainment for its customers or patrons. Thus, to in order to optimize the entertainment value provided to the consuming public, casinos must keep track of statistics such as the number of bets placed per square foot of casino space and the dollar amount spent per consumer per square foot of casino space. This type of analysis parallels the economic analysis used in retail stores, in that the operators must look at the ratio of sales dollars per square foot of casino floor. In gaming, a particular bet or wager is a sale. Therefore, sales for a casino depend on the number of wagers and the amount bet per wager. Accordingly, in order to improve the sales of a particular casino, the operators must seek to increase the number of wagers and the amount bet per wager.

Blackjack is staple in many casinos. The longevity of this game is due in large part to the fact that it is easy to learn and the consuming public has a fairly good chance of beating the casino. Conventional Blackjack is also known as Twenty One is described in U.S. Pat. No. 5,257,789 to LeVasseur and U.S. Pat. No. 5,413,353 to Demarest et al., both of which are incorporated herein in their entirety by reference. A significant aspect of these games is that the dealer or bank must make his play decisions based on fixed, predetermined criteria. Typically, these criteria include that a dealer must continue to take cards so long as his hand does not add up to 17 or more than 21. If the cards add up to seventeen or more, without "busting," then the dealer must hold and use this hand against the players who have not busted or gone over 21.

An important problem associated with conventional Blackjack is that it inherently limited in the number of wagers that a particular player can place. This problem is present in both table versions of the game, where a single dealer or bank plays against one or more players, and in video or computerized versions of the game where a single player plays against a virtual or computerized dealer or bank. The fact that the player is matched against a single dealer limits the number of transactions or bets that can be carried out at a particular gaming station, whether the gaming station involves live players or a player playing against a computerize, video Blackjack dealer. Thus, the limited number of transactions limits the number or sales or revenue that can be produced from a particular station, leaving the dollar amount played per game as the only variable that can be used by casino operators to attempt to increase the sales per square foot of casino space.

There have been attempts at increasing the productivity of Blackjack stations or tables, but these attempts have resulted in limited success due to the complications or variations introduced to the Blackjack game, or due to the limitations that reduce the productivity of the Blackjack station. For example the above reference invention to LeVasseur allows each player to place several bets at distinct locations on the Blackjack table. The dealer has a corresponding number of card locations for playing against the players. The dealer deals cards to each of the player bet locations and then deals and plays a first round against the first bet location in a conventional manner. The dealer then uses the first card from this first round to play a second round against the second bet location of each player. The process continues until the dealer has used the first card as a basis for playing against all of the player bet locations.

A significant problem associated with the LeVasseur system is that in order to fully exploit the productivity of that system, all players must bet the same number of bets. Thus, if some players only want place two bets, while another player wants to place five bets, the player who placed only two bets must wait until the five bet player is finished before commencing another round.

Thus, there remains a need for a Blackjack gaming system that increases the productivity of Blackjack stations without complicating known Blackjack rules or decision criteria as widely accepted by casinos.

Still further, there remains a need for a Blackjack gaming system that can be automated and that allows a player to make decisions on a single hand to determine the outcome on several wagers. Particularly, there remains a need for such a system that can accommodate more than three wagers per player.

There remains a need for a Blackjack gaming system that enhances the productivity of the Blackjack gaming station and that can be played as a table game, as an electronic or video game, or as part of a game carried out through a local area network or widely reaching network, such as the Internet.

There remains a need for a Blackjack gaming system that results in several bets or wagers being settled from a single player decision.

SUMMARY

It has been discovered that the problems left unanswered by known gaming systems can be solved by providing a gaming system based on Blackjack, the gaming system allowing a single player, or several individual players to play against several dealers or dealer hands. According to one example of the invention, a player selects the number of dealers or dealer hands that the player will play Blackjack against. The player makes this decision and places the corresponding number of bets or bets. For example, if the player wants to play against five different dealers or dealer hands, then the player would place five bets, meaning a wager against each of the dealers. The person can wager different amounts each dealer. Then the player would be dealt his cards in a conventional manner, and each dealer or dealer hand would be dealt in a conventional manner. Thus, the player would be dealt a card, face up, and each of the dealer hands would be dealt a card, face up. Then the player would be dealt a second card, face up, and each of the five dealers would be dealt a card face down. The player would then make a decision of the range of hand values, meaning the sum of the values of the cards in the hand, at which the player would stay or take a "hit," meaning asking for another card. Once the player makes this decision, he will continue to accept new cards until he reaches the minimum value on which he has decided to stay. Then, each of the dealers' hands is played based on a pre-determined criteria. A commonly used criterion is to continue taking cards until the dealer's hand adds up to at least seventeen, without going over twenty one. Thus, the first dealers' hand will be played until the stay criteria has been met, and the hand's value is compared to the player's hand. Then the player would win, lose, or recover the wager depending on the pre-established rules of the game. For example, if it is established that a player's bet is refunded in the event of a tie, then the player's hand needs to be of a score that is higher than the dealers' hand being played in order to win more than the bet placed with that dealer. The process is repeated with successive dealers' hands until all of the different dealers' hands are compared to the player's hand and the bets with each of the dealers' hands settled.

According to one example of the invention, it is contemplated that in addition to the system as outlined above, a bonus prize bet may be added to the game. The bonus prize bet would allow the player to place a parallel bet before the game begins. For example the bonus, or parallel, bet could be based on the chance of drawing certain cards when the hand is originally dealt. If this hand is dealt to the player, then the player automatically wins the bonus bet. It is important to note that this is only an example of the bonus bet, and the bonus bet mechanism may be implemented in various other ways. For example a progressive bonus, where the bonus prize increases depending on the number of bets, size of bets, rounds or games played.

Additionally, it is contemplated that the automated embodiment of the invention will play each round with an electronic deck or decks of cards that has been "reshuffled," allowing the random drawing of cards from these decks. The number of decks used per round will depend on the number of players and dealers selected by the person playing the game.

Still further, it is contemplated that the disclosed multi-dealer blackjack system may be adapted for play over a computer network, such as the Internet. In such an arrangement, an individual uses a credit card, debit card, or funds transfer method to place a wager that is to be credited to a casino or dealer that is carrying out the gaming decisions through a remote computer connected to the player's computer through a network. The account would serve to credit the individual for wins or ties accumulated during play.

Thus, it is understood that a number of variations may be effectively carried out based on the disclosed principles. It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
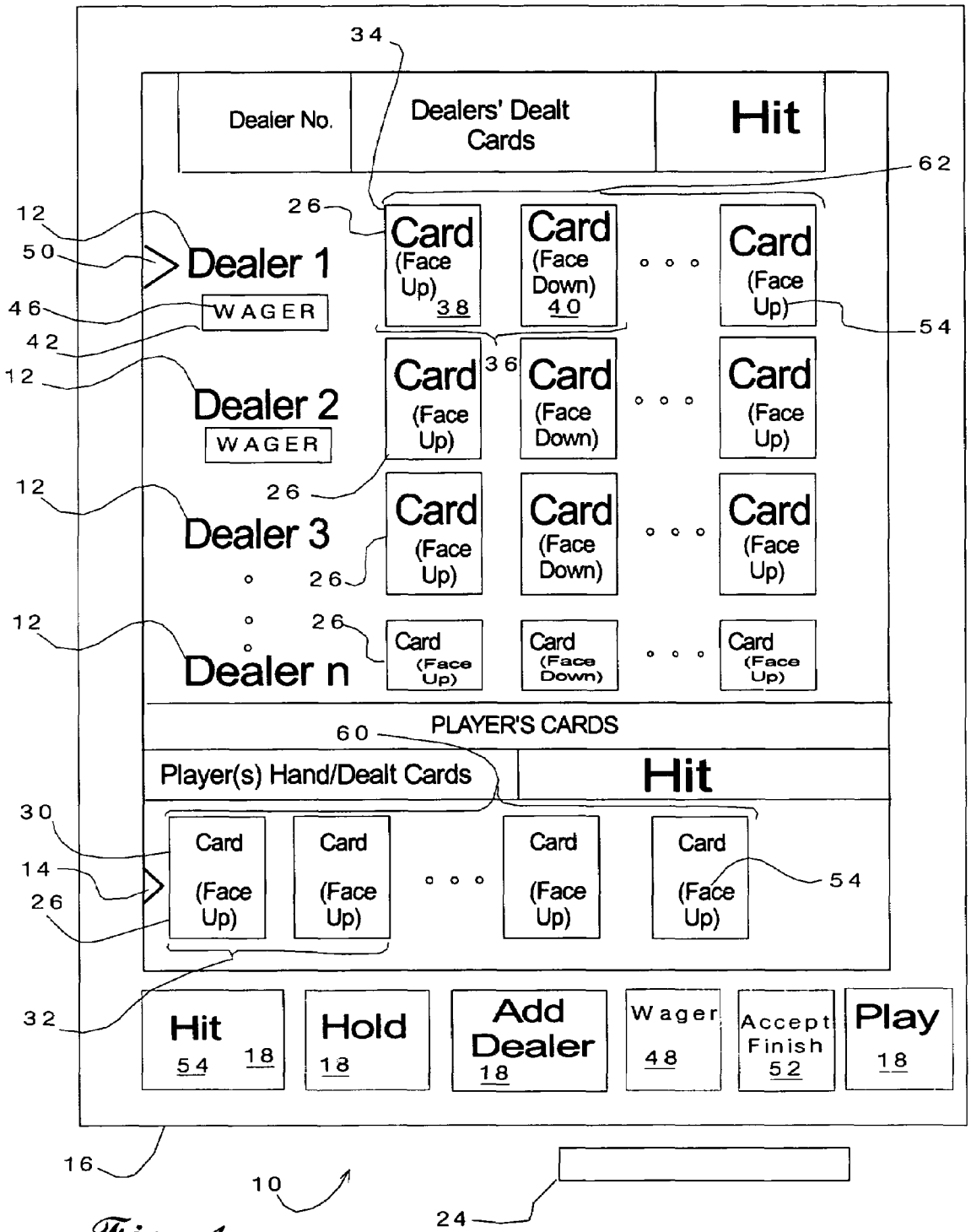
FIG. 1 illustrates an example of the facade of an automated or computerized system utilizing the disclosed invention.
Figure 2:
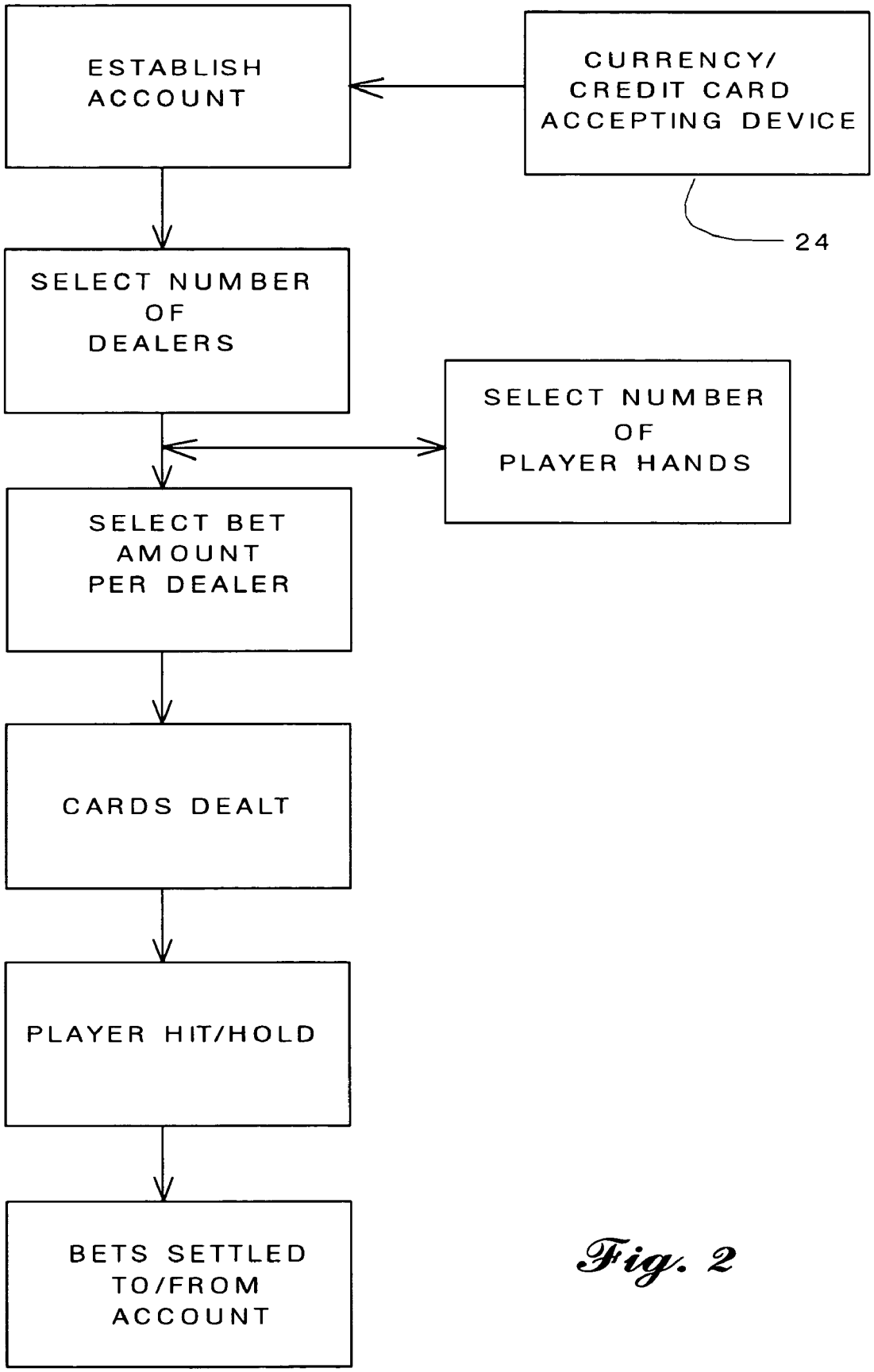
FIG. 2 is a flow diagram carrying out steps of the disclosed system.

Turning now to FIG. 1 where an electronic gaming system 10 based on a Blackjack card game has been illustrated. It is contemplated that the game will be played according to a set of rules of Blackjack, which as described above, are well know and include many known variations. The disclosed system 10 is designed to provide a player with the same experience as when playing on a standard table game, but will provide important new and useful improvements in terms of number of wagers per hour achieved on a given area of casino floor. Thus, it is contemplated that the gaming system will employ a dealer hold criteria, such as holding at a card sum value of sixteen or above.

As illustrated in FIG. 1, an important example of the disclosed system 10 provides multiple independent dealer 12 or dealer locations. Each dealer 12 will respond in accordance with the dealer hold criteria, which has been pre-established by the casino and programmed into the system. The player 14 will interact with or play the game, which will be displayed on a screen 16. The interaction or of the player 14 with the system 10 will be by pressing command buttons 18 that may be mechanical switches or touch actuated screen based buttons that are electronically controlled through software.

Thus, it is contemplated that, in addition to the display screen 16, the disclosed system 10 will also include a memory 20, and a processor 22 that will carry out the instructions programmed or stored in the memory 20. In this sense, the disclosed system 10 will be programmed to carry out the steps disclosed herein, which are intended to greatly enhance the use of casino floor space and the overall productivity of the casino by increasing the number of wagers consummated from a single player decision.

To use the system 10, the player 14 will either insert currency into a currency-accepting device 24 in the system 10 or create or access an account, such as an account credited through a credit card. When using a credit card, it is contemplated that the system 10 will incorporate a credit card reader or a screen prompt that will allow the user or player to enter credit card information into the system 10, so that the system 10 can then establish an account for the player 14. The sums credited to the player may be sums drawn from the credit card or sums derived from wagering on the system 10, can be used by the player for placing additional wagers.

Figure 3:
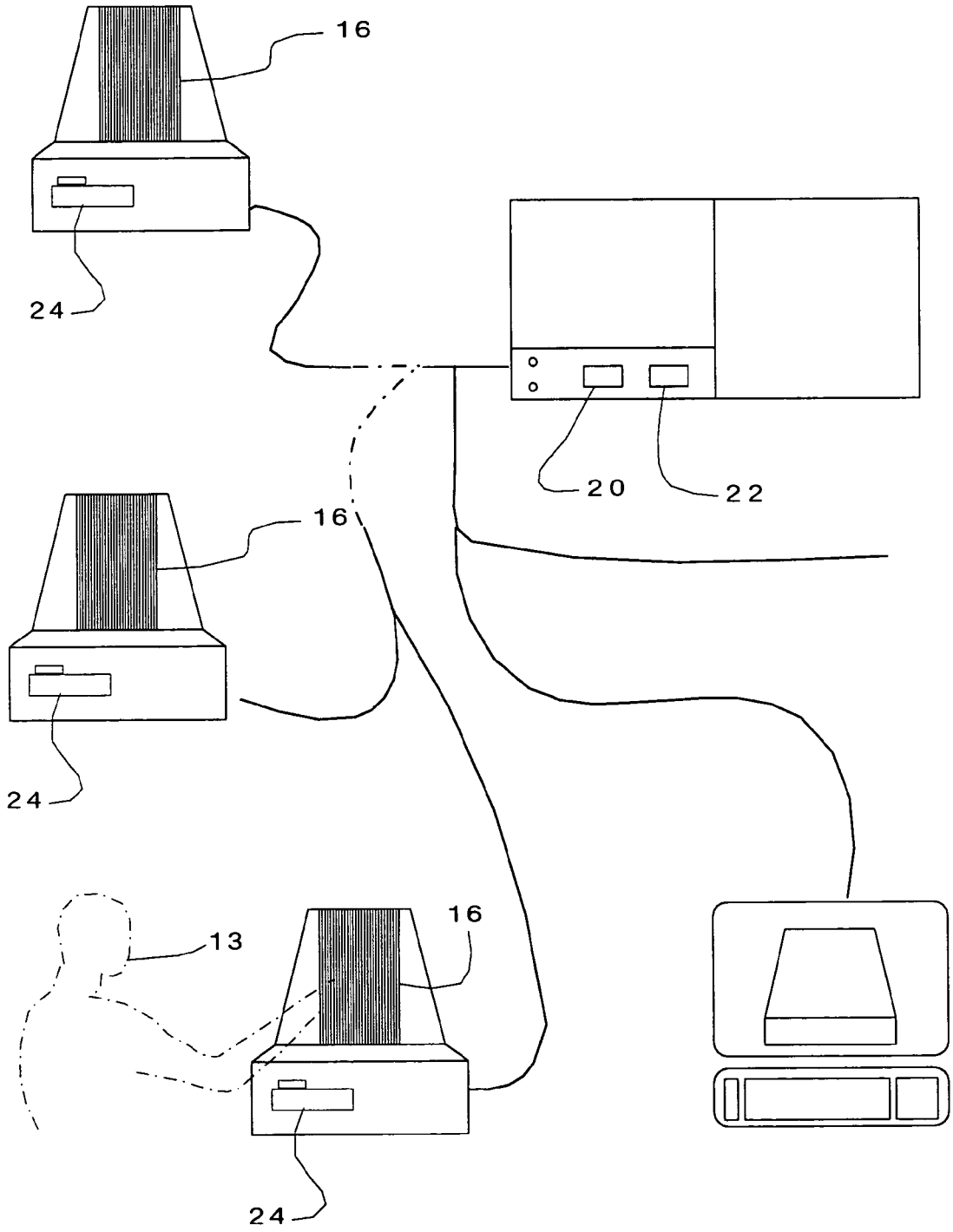
FIG. 3 is a schematic diagram of an automated system that is used to practice the disclosed invention with the use of computer that is connected to a network of computers.

Once the player 14 has established an account, or given credit for funds deposited with the system 10, the screen 16 of the gaming station, or system 10, will display the number of dealers as selected by the person 13, illustrated in FIG. 3. It is important to note that with the disclosed system, the person 13 may select to use more than one player 14, and thus allow the person 13 to decide for different virtual players, each playing against one or more virtual dealers. Thus, as used herein, a player or players refers to a virtual player controlled by a single person, and the decisions of that person become the "decision" of the player or players.

As an example of play, if the minimum bet for play has been set at two dollars, then a player 14 who wishes to play against five different dealers at the minimum bet would simply apply ten dollars to the wager and instruct the system 10 to display five different dealers 12. The wager or bet may be placed from an account created as described above, for example, or from currency deposited into the system 10. It is important to note that it is contemplated that the player 14 will not be limited to wagering the same amount with each dealer, but will be allowed to place bets in any desired amount over the bet with each dealer. The wagers may be placed at wager placement positions corresponding with each dealer hand position 36.

According to one example of the invention, after the desired number of dealer positions are selected and wagers 46 placed at wager placement positions 42, cards 26 will be dealt electronically to a single player hand position 28 and to each of the dealers 12 at dealer hand positions 44.

The wagers 46 will have been entered by the player 14 by way of a wager button 48 that allows the player to increase the wager 46 in predetermined amounts. An active dealer indicator 50, which may be a highlight area or pointer or the like, would be used to let the player 14 know what dealer 12 the player 14 is betting against. Additionally, it is contemplated that a separate "accept/finish" button 52 will also be incorporated to allow the player 14 to proceed to the next step or dealer. For example, if the bet is two dollars, and the system 10 has been programmed to increase wagers in one dollar increments, then the player 14 would simply press the wager button 48 until the desired wager is achieved for the active dealer. Once the player 14 has reached the desired wager level for that dealer, then the player 14 simply presses the accept/finish button 52 to activate the next dealer 12. The active dealer indicator will then move to the next dealer 12, prompting the player 14 commence pressing the wager button 48 until the desired wager for that dealer 12 has been reached. The player 14 then simply presses the accept/finish button 52 and the next dealer 12 will become active. The steps are repeated until the last dealer 12 has been reached, meaning that the desired wager for each dealer 12 has been placed.

Thus, it will be understood that in one embodiment of the disclosed system allows the player 14 to select the number of dealers and the bet amount for each dealer. This allows the player to risk different amounts at different positions, adding variety to the game. However, it is contemplated that the system 10 may be programmed such that all dealers 12 will receive the same wager. Additionally, it is contemplated that the each of the dealers may be represented as separate characters or personalities, allowing the player to associate wins with a particular character or personality and thus allowing the player to associate wins with that character, prompting the player to place higher wagers with that particular dealer on future rounds of play.

After the wagers have been placed, it is contemplated that card distribution will begin. During this stage the player hand position 28 will be dealt a pair of cards 26, both cards with the face 54 shown, creating a player hand 30. Additionally, a dealer hand 36 will be dealt with one card 26 with its face 54 shown, and one card 26 face down, with the back 56 of the card 26 shown. At this point, the player will analyze all of the faces 54 shown for each of the dealers 12. If the player sees that the dealer hands 36 are showing hands that predominantly include high cards, such as aces, kings, queens, jacks, tens, then the player 14 will make a decision as to whether to take a "hit" or hold. A separate "hit" button 58 becomes active at this stage, and the player 14 will simply press the hit button 58 to draw another card for the player hand 30. If the player hand 30 does not add up to more than 21, and the player wishes to complete play, the player may then press the accept/finish button 52, which may also include the label "hold." By holding, the player 14 creates a player hold hand 60.

The system 10 will then activate each dealer hand 36 in a sequential manner. When a dealer hand 36 becomes active, the system 10 will then use the programmed hold criteria, programmed in through the systems memory 20 and applied through the processor 22, to add cards to the active dealer hand 36 until the dealer criteria indicates that the dealer must hold to create a dealer hold hand 62. Of course, a dealer hand 36 may "bust" or go over 21 while cards are being dealt to a particular dealer before that dealer's hold hand 62 is reached. After this process is completed for each dealer, the system 10 will compare the remaining dealer hold hands 62 with the player hold hand 60 and crediting the player's account for the dealer hold hands 62 that were inferior to the player hold hand 60 or for the dealer hands 36 that busted, or which adds to more than 21. In other words, crediting the player's account for each winning player hand.

Thus, it will be understood that the disclosed system allows the use of the decisions used to form a single player hold hand 60 to settle multiple wagers. This greatly enhances casino productivity in that the time used to create the single player hold hand will typically remain constant for a given player. Thus, maximizing the number of hands settled by a given player for a specified unit of time.

Additionally, it is contemplated that more than one player hand 30 may be used with the system 10. To do this, the system would provide another button that would allow the person using the system to add virtual players. Each of these virtual players would play against the selected number of dealers in the same manner as described above. However, this may reduce productivity by complicating the system and increasing the number of decisions for the player.

It is also important to note that it is contemplated that each round of play may also be commenced with the use of more than one deck of cards programmed into the system 10, and thus enhancing the play over manual, table-top systems that require that the decks of cards be depleted before all of the cards are placed into play in succeeding rounds. Still further, it is contemplated that the system may be programmed such that the player 14 will be paid a bonus amount when the winning player hand is the same as or meets the bonus hand criteria programmed into the system. Thus, the bonus may be defined as a winning player hand that includes a pair of fours or any other pair or card.

Still further, it is contemplated that the disclosed system 10 may be programmed to further reduce the decision making time for the player. This may be accomplished by limiting the hands of the individual dealers 12. For example, it is contemplated that all dealers 12 may be limited to the same face up 38 card, with the second, face down 40, card being random. This variation may also be played with a single player hand or multiple player hands that are being played by the same person.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An electronic gaming method based on a Blackjack card game played according to a set of rules of Blackjack, the gaming method using a dealer hold criteria and allowing a single player at a location to play blackjack against a plurality of dealers from a casino, the gaming method comprising:

Providing a player to select a number of independent dealer hand positions comprising of at least two dealer hand positions;

Providing at least two player hand positions;

Providing wager placement positions corresponding with each dealer hand position;

Crediting the player for a wager placed in each wager position;

Dealing a separate pair of cards for each player hand position to create a player hand at each player hand position;

Dealing a separate pair of cards to each of the dealers hand positions, each of the dealers hand positions receiving one card face up;

Dealing cards to each player hand position at the request of the player to create a player hold hand at each player hand position;

Dealing cards to each dealer based on the dealer hold criteria to create a dealer hold hand for each dealer;

Then comparing, based on the rules of Blackjack, the single player hold hand at each player hand position to each dealer hold hand to determine if the player hold hand at each player hand position wins over any of the dealer hold hands and crediting the single player for each dealer hold hand that is beat by the player hold hand and crediting the casino for each dealer hold hand that is not beat by a player hold hand, so that the single player carries out multiple games of blackjack based on the player hold hand at each player hand position.

2. A method according to claim 1 and further comprising:

Providing a display screen at a gaming location and displaying the dealer hand positions and the player hand position on the display screen.

3. A method according to claim 2 and further comprising providing a processor at a remote location, the processor at a remote location being connected to the display screen by a network, and processing the dealer hold criteria with the use of the processor.

4. A method according to claim 3 and further comprising providing a memory and storing a bonus hand identity, using the processor for comparing a winning player hand with the bonus hand and paying the player a bonus amount when the winning player hand is the same as the bonus hand.

5. A method according to claim 2 and further comprising creating more than one player hands, and wherein the step of dealing cards to the player hand at the request of the player is carried out for each player hand at the request of the player.

6. A method according to claim 2 wherein the cards are randomly selected from at least one electronic card deck containing all of the cards not on display on the display screen.

7. An electronic gaming method to be displayed on a display screen, the gaming method based on a Blackjack card game played according to a set of rules of Blackjack, the gaming method being played on a gaming terminal having a display screen, a memory, and a processor, the method using a dealer hold criteria and allowing a single player at a location to play blackjack against several dealers from a casino, the gaming method comprising:

Providing a number of independent dealer hand positions, the number of independent dealer hand positions being selected by the single player and comprising at least two independent dealer hand positions displayed on the display screen;

Providing a single player position displayed on the display screen, the single player position having a player selected number of at least two player hand positions;

Providing wager placement positions displayed on the display screen, the wager placement positions corresponding to each dealer hand position and each player hand position;

Crediting the player for a wager placed in each wager position;

Dealing a separate pair of cards to the player for each player hand position at each player hand position;

Electronically dealing a separate pair of cards to each of the dealers hand positions, each of the dealers hand positions receiving one card face up; and Electronically dealing a separate pair of cards to each of the player hand positions at the request of the player to create a set of player hold hands; and then Dealing cards to each dealer based on the dealer hold criteria to create a dealer hold hand for each dealer;

Then comparing, based on the rules of Blackjack, each of the player hold hand to each dealer hold hand to determine if the player hold hand wins over any of the dealer hold hands and crediting the single player for each dealer hold hand that is beat by the player hold hand and crediting the casino for each dealer hold hand that is not beat by a player hold hand, so that the single player carries out multiple games of blackjack based on the player hold hand.

8. A method according to claim 7 and further comprising providing a memory and a processor at a remote location, the processor at a remote location being connected to the display screen by a network, and processing the dealer hold criteria with the use of the processor and the memory.

9. A method according to claim 8 and further comprising creating more than one player hands, and wherein the step of dealing cards to the player hand at the request of the player is carried out for each player hand at the request of the player.

10. A method according to claim 9 wherein the cards are randomly selected from at least one electronic card deck containing all of the cards not on display on the display screen.

11. A method according to claim 10 and further comprising storing a bonus hand identity, using the processor for comparing a winning player hand with the bonus hand and paying the player a bonus amount when the winning player hand is the same as the bonus hand.

12. An electronic gaming system based on a Blackjack card game played according to a set of rules of Blackjack, the gaming system using a dealer hold criteria and allowing a single player at a location to play blackjack against several dealers from a casino, the gaming system comprising:

A gaming station having a display screen, a memory, and a processor, the screen of the gaming station displaying:

User selectable quantity of independent dealer hand positions, the quantity of independent dealer hand positions being at least two dealer hand positions;

at least two player hand positions; and wager placement positions corresponding with each dealer hand position and each player hand position;

the system being programmed for:

crediting the player for a wager placed in each wager position;

Dealing a separate pair of cards to each of the player hand positions;

Dealing a separate pair of cards to each of the dealers hand positions, each of the dealers hand positions receiving one card face up; and Dealing cards to the player at the request of the player at each player hand position to create a player hold hand;

Dealing cards to each dealer based on the dealer hold criteria to create a dealer hold hand for each dealer;

Then comparing, based on the rules of Blackjack, the player hold hand to each dealer hold hand to determine if the player hold hand wins over any of the dealer hold hands and crediting the single player for each dealer hold hand that is beat by the player hold hand and crediting the casino for each dealer hold hand that is not beat by a player hold hand, so that the single player carries out multiple games of blackjack based on the player hold hand.

13. A system according to claim 12 wherein the processor has been programmed for carrying out the dealer hold criteria with the use of the processor.

14. A system according to claim 13 and further comprising more than one player hands, and wherein the step of dealing cards to the player hand at the request of the player is carried out for each player hand at the request of the player.

15. A system according to claim 13 and further comprising a bonus hand identity, and using the processor for comparing a winning player hand with the bonus hand, so that a player is paid a bonus amount when the winning player hand is the same as the bonus hand.

16. A system according to claim 12 wherein the cards are randomly selected from at least one electronic card deck containing all of the cards not on display on the display screen.

* * * * *